US008616862B2

(12) United States Patent
Meza et al.

(10) Patent No.: US 8,616,862 B2
(45) Date of Patent: Dec. 31, 2013

(54) DISPOSABLE PUMP HEAD

(75) Inventors: Humberto Valenzuela Meza, Tustin, CA (US); Adam Hart, Braintree (GB); Manuel Villagomez, Jr., Corona, CA (US)

(73) Assignee: Xylem IP Holdings LLC., White Plains, NY (US)

( * ) Notice: Subject to any disclaimer, the term of this patent is extended or adjusted under 35 U.S.C. 154(b) by 330 days.

(21) Appl. No.: 12/889,011

(22) Filed: Sep. 23, 2010

(65) Prior Publication Data

US 2011/0070107 A1 Mar. 24, 2011

Related U.S. Application Data

(60) Provisional application No. 61/245,533, filed on Sep. 24, 2009.

(51) Int. Cl.
*F04B 17/00* (2006.01)

(52) U.S. Cl.
USPC ..... 417/413.1

(58) Field of Classification Search
USPC ..... 417/269, 395, 375, 413.1, 454, 569, 417/571, 572
See application file for complete search history.

(56) References Cited

U.S. PATENT DOCUMENTS

| | | | |
|---|---|---|---|
| 4,187,057 | A | 2/1980 | Xanthopoulos |
| 4,211,519 | A | 7/1980 | Hogan |
| D264,134 | S | 4/1982 | Xanthopoulos |
| 4,537,561 | A | 8/1985 | Xanthopoulos |
| 4,631,008 | A | 12/1986 | Stenner |
| 4,798,580 | A | 1/1989 | DeMeo et al. |
| 5,125,891 | A | 6/1992 | Hossain et al. |
| 5,195,960 | A | 3/1993 | Hossain et al. |
| 5,282,787 | A | 2/1994 | Wortrich |

(Continued)

FOREIGN PATENT DOCUMENTS

| | | |
|---|---|---|
| EP | 0164020 | 12/1985 |
| EP | 0339857 | 11/1989 |
| WO | 9410446 | 5/1994 |
| WO | 2007080499 | 7/2007 |

OTHER PUBLICATIONS

Extended European Patent Office Search Report issued Jan. 26, 2011 in corresponding EP patent application No. 10178624.2 (7 pages).

*Primary Examiner* — Devon Kramer
*Assistant Examiner* — Charles W Nichols

(57) ABSTRACT

A disposable pump head and canister assembly is provided having a disposable pump head having an upper housing with an input port and an output port, and being configured to be engaged to a motor so as to pump fluid into the input port, through the disposable pump head, and out the output port, the upper housing configured to couple to a support plate via a plurality of upper housing flexible tabs that snap fit to corresponding structure of the support plate and configured to be frictionally engaged to a motor so as to pump fluid into the input port, through the disposable pump head, and out the output port; and a canister having an exterior wall portion, a cover and a latching arrangement, where the exterior wall portion is configured so as to form an interior cavity dimensioned to receive the disposable pump head, and where the cover is configured to close and be latched to the exterior wall by the latching arrangement so as to frictionally engage the disposable pump head and the motor.

5 Claims, 11 Drawing Sheets

(56) References Cited

U.S. PATENT DOCUMENTS

| | | | | |
|---|---|---|---|---|
| 5,356,267 | A | 10/1994 | Fulmer | |
| 5,447,417 | A | 9/1995 | Kuhl et al. | |
| 5,549,458 | A | 8/1996 | Chapman et al. | |
| 5,746,719 | A | 5/1998 | Farra et al. | |
| 5,897,524 | A | 4/1999 | Wortrich et al. | |
| 6,048,183 | A * | 4/2000 | Meza | 417/569 |
| 6,270,673 | B1 * | 8/2001 | Belt et al. | 210/646 |
| 6,319,223 | B1 | 11/2001 | Wortrich et al. | |
| 6,322,488 | B1 | 11/2001 | Westberg et al. | |
| 6,554,791 | B1 | 4/2003 | Cartledge et al. | |
| 6,890,161 | B2 | 5/2005 | Paukovits, Jr. et al. | |
| 7,040,876 | B2 * | 5/2006 | Fukami et al. | 417/413.1 |
| 7,074,021 | B2 | 7/2006 | Byrne | |
| 7,311,691 | B2 | 12/2007 | Cartledge et al. | |
| 7,473,238 | B2 | 1/2009 | Brugger et al. | |
| 2003/0217975 | A1 | 11/2003 | Yu et al. | |
| 2004/0009075 | A1 * | 1/2004 | Meza et al. | 417/32 |
| 2006/0073036 | A1 * | 4/2006 | Pascual et al. | 417/413.1 |
| 2008/0145249 | A1 | 6/2008 | Smisson et al. | |
| 2008/0279702 | A1 * | 11/2008 | Kim | 417/413.1 |

* cited by examiner

FIG. 5a(ii)

FIG. 5a(iii)

FIG. 5a(vii)

FIG. 5b(ii)

FIG. 5b(iii)

FIG. 5b(vii)

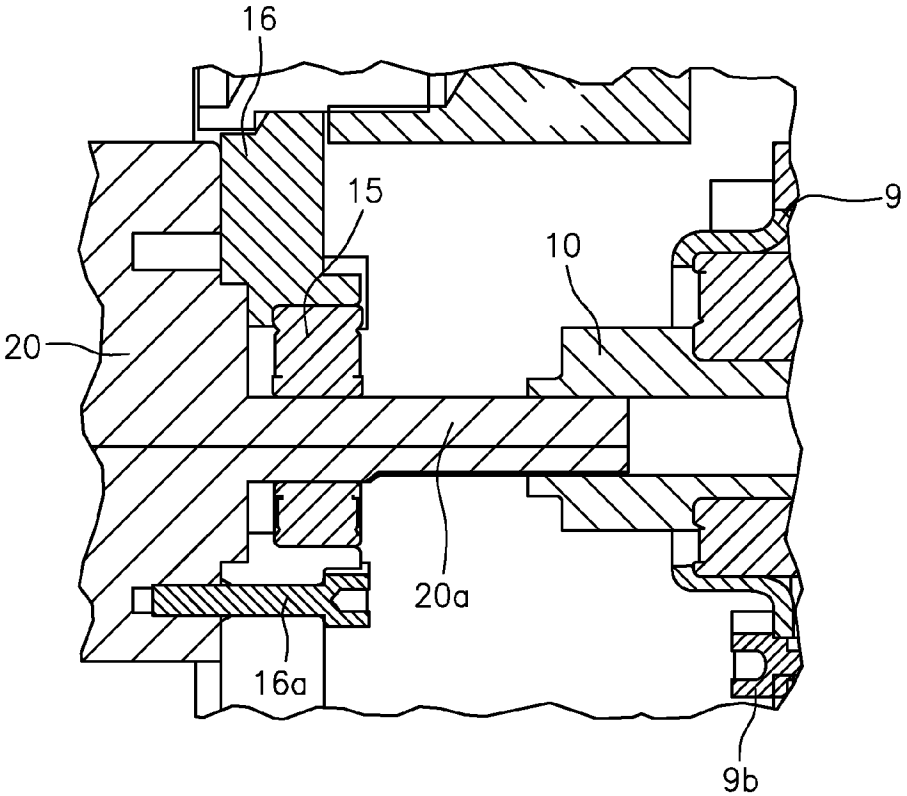
FIG. 6b
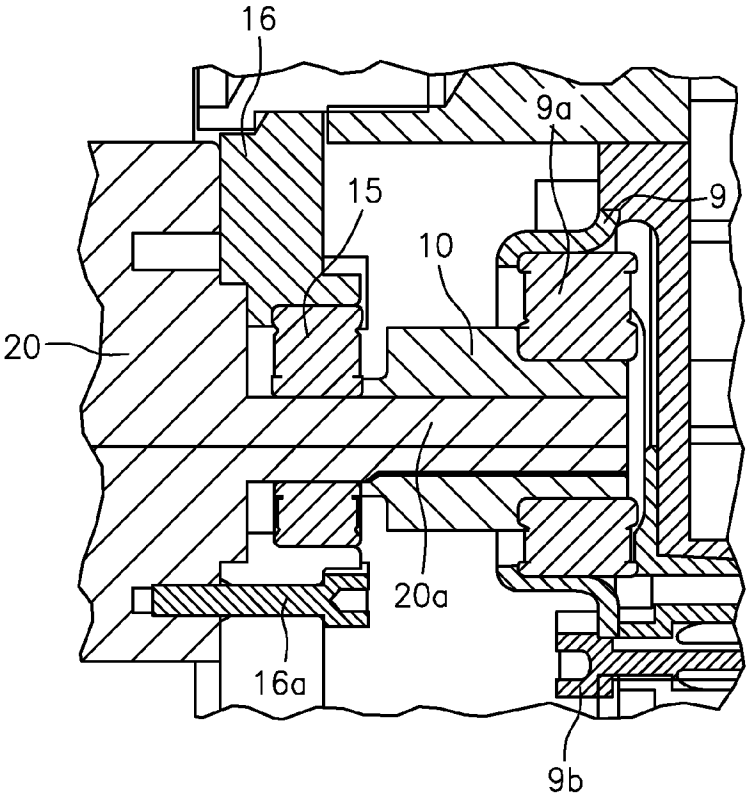
FIG. 6a
FIG. 6

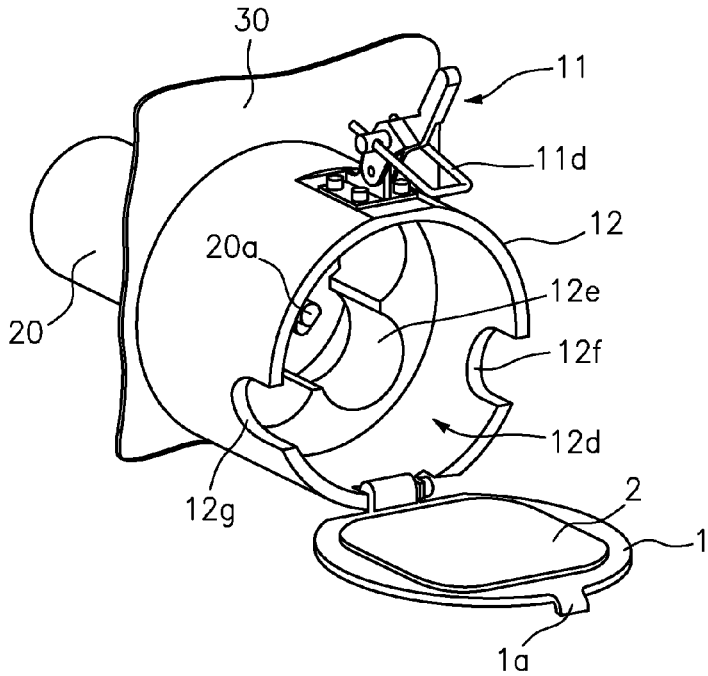
FIG. 8a
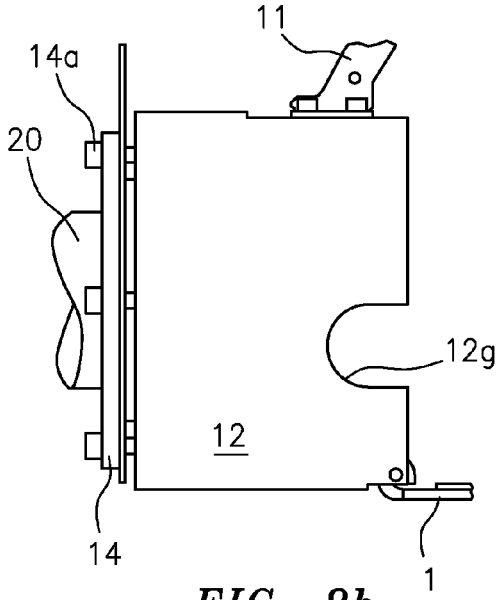
FIG. 8b
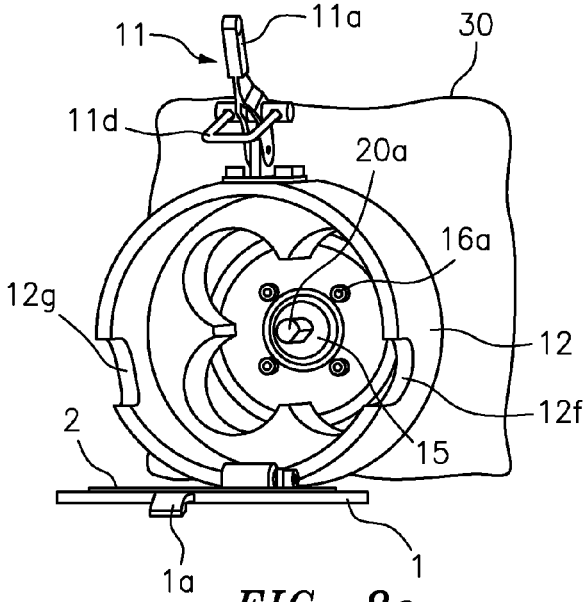
FIG. 8c
FIG. 8

DISPOSABLE PUMP HEAD

CROSS REFERENCE TO RELATED APPLICATIONS

This application claims benefit to provisional patent application No. 61/245,533, filed 24 Sep. 2009, which is hereby incorporated by reference in its entirety.

BACKGROUND OF THE INVENTION

1. Field of the Invention

The present invention relates to a pump head; and more particularly to a pump head that is disposable.

2. Brief Description of Related Art

It is known in the art that after some applications, operations, or procedures, a pump must be cleaned and sanitized before a next application, operation or procedure. This cleaning and sanitizing process can result in unwanted delay and adverse exposure to certain media, including the potential for cross contamination of materials. Currently, in the marketplace known techniques include using peristaltic pumps for such applications, along with diaphragm pumps that require cleansing and/or sanitizing between product batches. Other shortcomings of these known techniques also include the maintenance time and the potential for contact with the fluids being pumped.

In view of this, there is a need in the industry for a new technique for use in such applications, operations or procedures, where the maintenance is simple, which allows for easy change of materials being pumped so there is no need for cleaning and/or sanitizing, so the next application, operation and procedure may be started with less delay or exposure to the media being pumped, and which may even allow for a simple disposal that will eliminate the potential for cross contamination of materials.

The present invention provides such a new technique, consistent with that described herein.

SUMMARY OF THE INVENTION

The present invention provides a pump featuring a disposable pump head assembly and a canister.

The disposable pump head assembly has an input port and an output port, and is configured to be frictionally engaged to a motor so as to pump fluid into the input port, through the disposable pump head, and out of the output port.

The canister has an exterior wall portion, a cover and a latching arrangement, where the exterior wall portion is configured so as to form an interior cavity dimensioned to receive the disposable pump head, and where the cover is configured to close and be latched to the exterior wall portion by the latching arrangement so as to frictionally engage the disposable pump head and the motor.

The cover has a compressible pad dimensioned so as to push a top surface of the disposable pump head so as to frictionally engage the disposable pump head and the motor.

The cover may be arranged on a hinge. The latching arrangement may comprise a part for grabbing or latching to a lip formed in the cover. The disposable pump head may be a diaphragm pump comprising an upper housing, a valve housing, reciprocating pistons, a diaphragm, an outer piston plate, a bearing housing and a cam for coupling to a shaft of the motor.

In one particular embodiment, the disposable pump head assembly may include a bearing housing configured with outer walls having a predetermined shape and defining openings for receiving reciprocating pistons. The disposable pump head assembly is also configured with the cam configured to be coupled to the motor for moving the reciprocating pistons so the disposable pump head assembly can pump fluid.

In the canister, the exterior wall portion may be configured to define a cavity to receive the disposable pump head assembly. A bottom wall portion may include interior walls formed therein with a corresponding predetermined shape that is substantially similar to the predetermined shape of the walls of the bearing housing to receive the disposable pump head assembly, and a lower portion of a diaphragm support plate may be configured to engage or press up against an upper portion of the bottom wall portion to prevent rotational movement of the disposable pump head assembly in relation to the canister when the cam moves the reciprocating pistons. The bottom wall portion may also be configured with an opening so that the cam can be coupled to the motor. The cover may be configured to detachably couple to the exterior wall portion for opening the canister to change the disposable pump head assembly and for closing the canister after the disposable pump head assembly has been changed.

The present invention may also take the form of the canister itself for receiving a disposable pump head assembly having the features set forth herein.

With the design of the disposable pump head and canister, the maintenance is a simple pull throw away and replace concept. This feature allows for the following:

The design according to the present invention allows for easy change of materials being pumped as there is no need for cleaning and/or sanitizing. The technician removes the disposable pump head, properly disposes it, then slips in a new pump head and clamps it in place and operations are started with little delay or exposure to the media being pumped.

This design allows for simple disposal that will eliminate the potential for cross contamination of materials.

BRIEF DESCRIPTION OF THE DRAWING

The drawing, which is not necessarily drawn to scale, includes the following Figures:

FIG. 6 includes FIG. 6*a* showing a view of a pump unit fully seated and engaged to a motor according to some embodiments of the present invention; and also includes FIG. 6*b* showing a view of a pump unit that slides out according to some embodiments of the present invention.

FIG. 7, including FIG. 7*a* shows a front view of the pump unit; where FIG. 7*b* shows a side view of the pump unit; where FIG. 7*c* shows a back perspective view of the pump unit, and where FIG. 7*d* shows a back view of the pump unit.

FIG. 8, including FIGS. 8*a*, 8*b*, 8*c*, shows views of a canister containment according to some embodiments of the present invention, where FIG. 8*a* shows a front side perspective view of the canister containment; where FIG. 8*b* shows a side view of the canister containment; and where FIG. 8*c* shows a front perspective view of the canister containment.

DETAILED DESCRIPTION OF THE INVENTION

Figure 1:
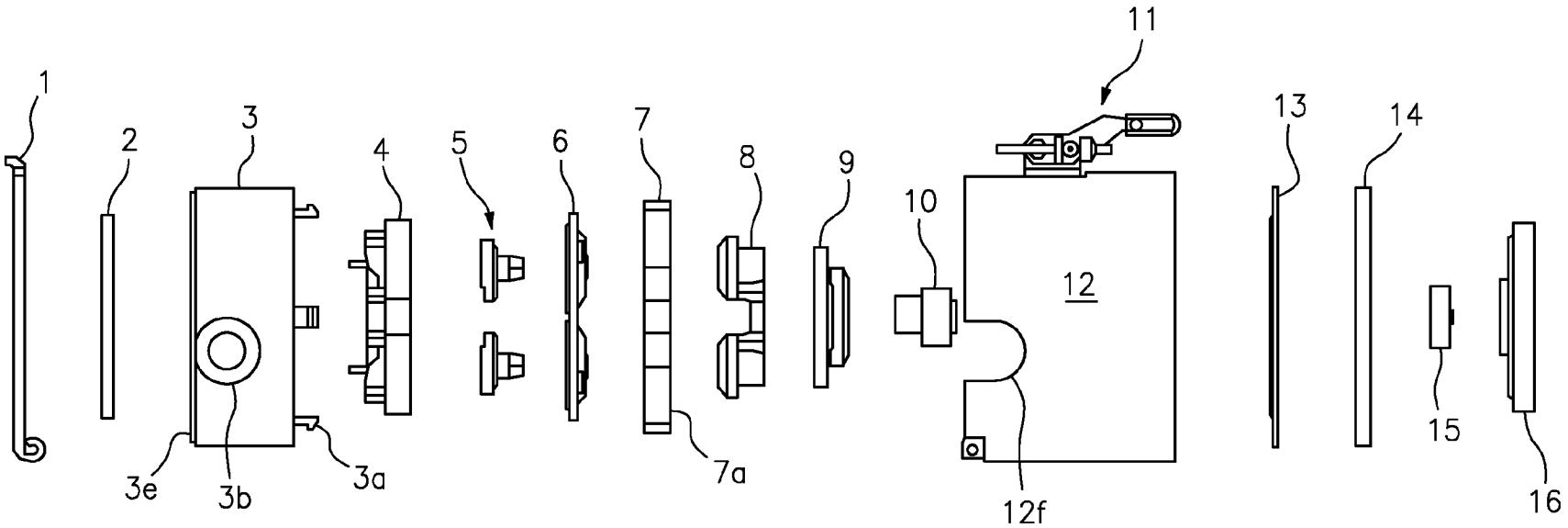
FIG. 1 is an exploded view of a disposable pump head and canister assembly according to some embodiments of the present invention.
Figure 1A:
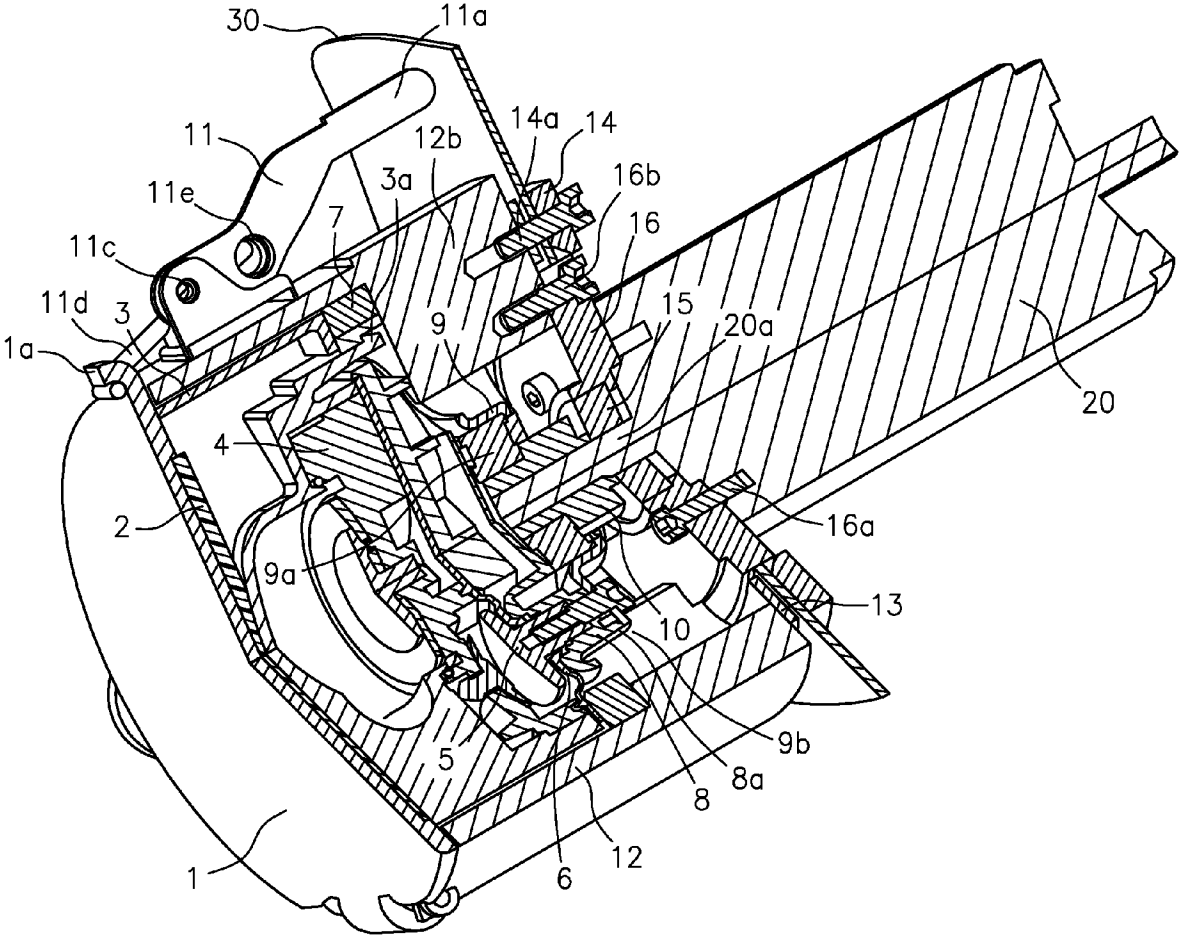
FIG. 1*a*, which is an exploded view of FIG. 5*b* (i), shows a disposable pump head arranged in a canister assembly according to some embodiments of the present invention.
Figure 1B:
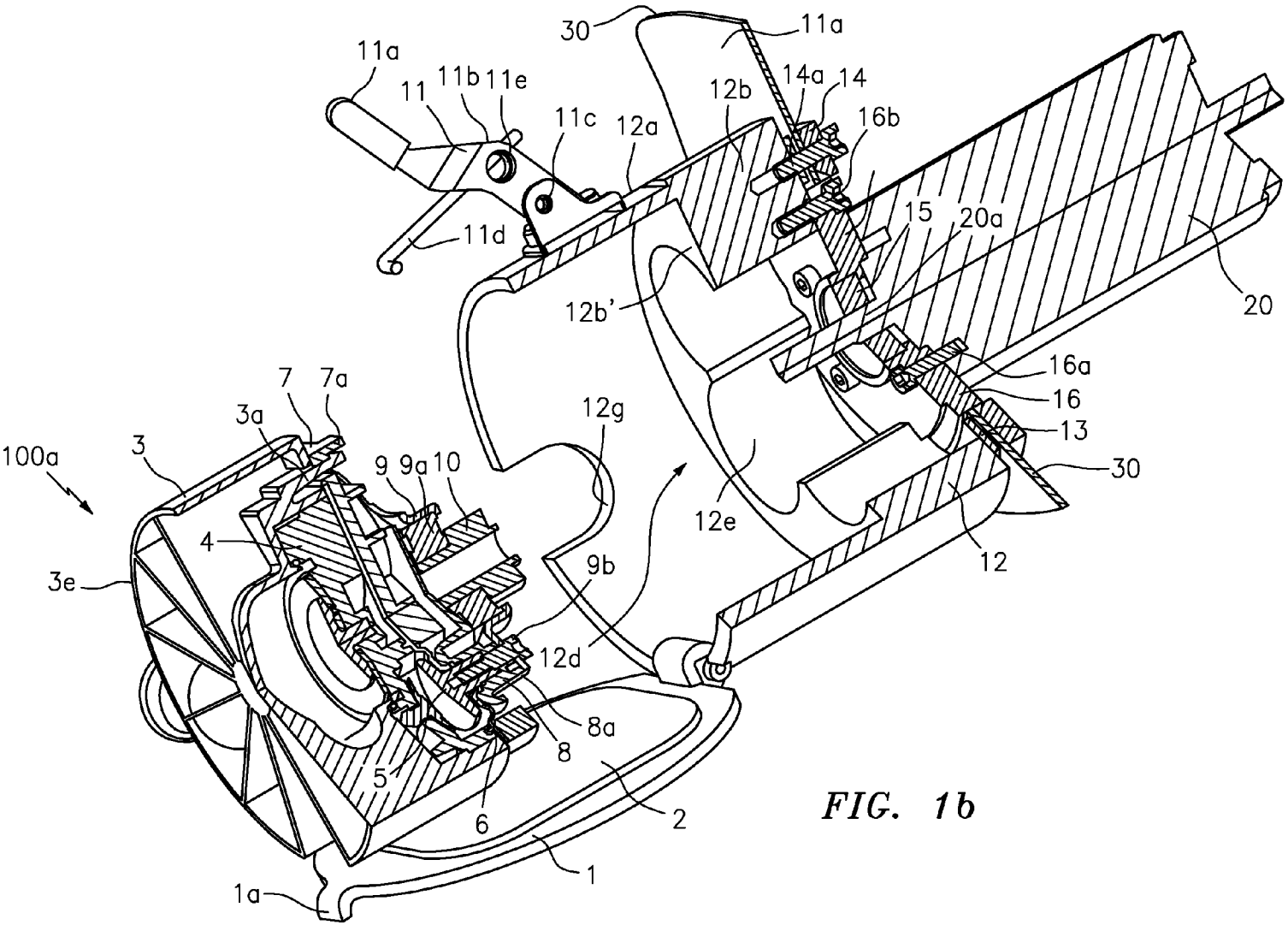
FIG. 1*b*, which is an exploded view of FIG. 5*b* (iv), shows the disposable pump head in FIG. 1*a* removed from the canister in FIG. 1*a* according to some embodiments of the present invention.

FIGS. 1, 1*a*, 1*b*

FIG. 1 shows a disposable pump head and canister assembly generally indicated as 100, which includes a cover 1, a pad 2, an upper housing 3, upper housing flexible tabs 3*a*, a valve housing 4, pistons 5, a diaphragm 6, a diaphragm support plate 7, an outer piston plate 8, a bearing housing 9, a cam 10, a clamp 11, a canister 12, a gasket 13, a mounting ring 14, a bearing 15 and a motor adapter 16. The upper housing 3, valve housing 4, pistons 5, diaphragm 6, the diaphragm support plate 7, outer piston plate 8, bearing housing 9, and cam 10 combine to make up the disposable pump head, also known as the disposable pump head assembly, generally indicated as 100*a* (see also FIGS. 1*a* and 1*b*) of the overall assembly 100; while the remaining elements combine to form the canister 12 and may include the cover 1, pad 2, clamp 11, canister 12, gasket 13, mounting ring 14, bearing 15 and motor adapter 16. By way of example, the present invention is shown and described in relation to the disposable pump head assembly 100*a* taking the form of a diaphragm pump, which is understood to be a positive displacement pump that uses a combination of the reciprocating action of a rubber, thermoplastic or Teflon diaphragm and suitable non-return check valves to pump a fluid, although the scope of the invention is not intended to be limited to any particular type or kind of pump either now known or later developed in the future.

FIGS. 1*a* and 1*b* show the disposable pump head assembly 100*a* as an assembled modular unit that is arranged inside the canister 12 in FIG. 1*a* and that is arranged outside the canister 12 in FIG. 1*b*. In FIGS. 1*a* and 1*b*, the disposable pump head assembly 100*a* and the canister 12 are arranged in relation to a motor 20. In FIGS. 1, 1*a* and 1*b* similar elements are labeled with similar reference numerals.

In FIGS. 1*a* and 1*b*, the upper housing 3 is configured to couple to the diaphragm support plate 7 via a plurality of upper housing flexible tabs 3*a* that snap fit to corresponding structure of the diaphragm support plate 7. By way of example, the present invention is described with the upper housing 3 being coupled to the diaphragm support plate 7 using a snap fit, although the scope of the invention is not intended to be limited to any type or kind of coupling technique either now known or later developed in the future. For example, the assembly of the various elements of pump head assembly 100*a*, including the upper housing 3, valve housing 4, pistons 5, diaphragm 6, the diaphragm support plate 7, outer piston plate 8, bearing housing 9, and cam 10, may take the form of a snap, screw, sonic weld, rivet, or any method of retention either now known or later developed in the future. Further, by way of example, the present invention is described with the plurality of upper housing flexible tabs 3*a* taking the form of four upper housing flexible tabs 3*a*, although the scope of the invention is not intended to be limited to any particular number of flexible tabs.

In FIGS. 1*a* and 1*b*, the valve housing 4, the pistons 5 and the diaphragm 6 are configured to be arranged between the upper housing 3 and the diaphragm support plate 7. The bearing housing 9 is configured to couple the bearing 9*a* and the outer piston plate 8 to the pistons 5 using four corresponding fasteners, one of which is labeled 9*b* (e.g. screws). The cam 10 is arranged in the bearing 9*a* as shown.

In FIGS. 1*a* and 1*b*, the outer piston plate 8 is configured with outer walls 8*a* having a predetermined shape and has openings for receiving the reciprocating pistons 5. The cam 10 is configured to be coupled to the shaft 20*a* of the motor 20 moving the reciprocating pistons 5 so the disposable pump head assembly 100*a* can pump fluid from the inlet port 3*b*, through the pump head, and to the outlet port 3*c*.

Figure 4:
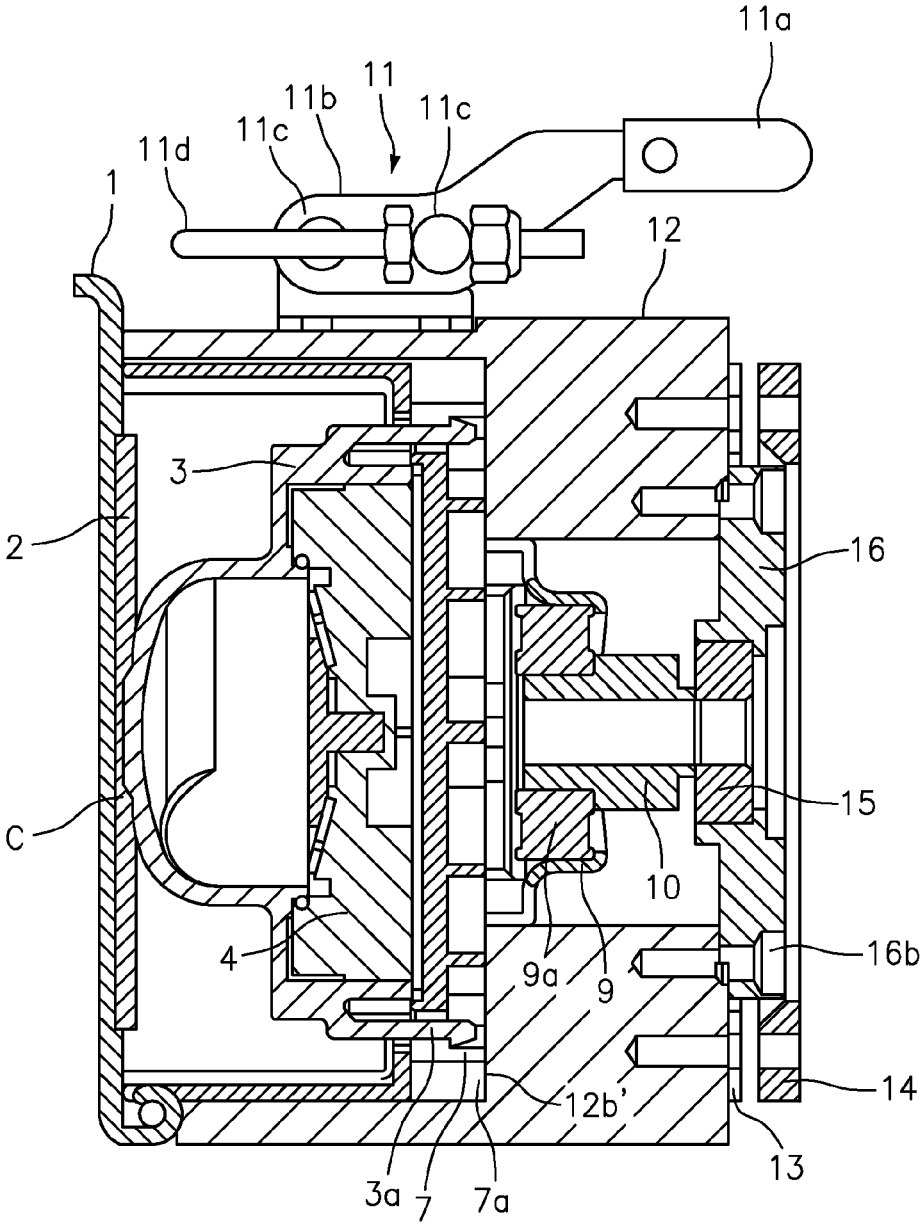
FIG. 4 is a sectional view of a disposable pump head and canister assembly according to some embodiments of the present invention.

The canister 12 is configured with an exterior wall portion 12*a*, the cover 1 and a bottom wall portion 12*b*. The exterior wall portion 12*a* is configured to define a cavity portion 12*d* to receive at least part of the disposable pump head assembly 100*a*. The bottom wall portion 12*b* is configured with interior walls 12*e* formed therein with a corresponding predetermined shape that is substantially similar to the predetermined shape of the walls 8*a* of the outer piston 8 to receive the outer piston 8. The cover 1 is latched so as to push the lower portion 7*a* of the diaphragm support plate 7 against an upper portion 12*b*' (FIGS. 1*b* and 4) so as to prevent rotational movement of the disposable pump head assembly 100*a* in relation to the canister 12 when the cam 10 moves the reciprocating pistons 5. In particular, the pad 2 may be a compressible member that is dimensioned so as to contact a top portion 3*e* of the upper housing 3 when the cover 1 is closed in order to push or urge the disposable pump head into the cavity 12*d* and frictionally engage the motor 20. As shown, the top portion 3*e* may be configured with members radiating from a central part and extending out to a rim, although other types or kinds of configurations on the top portion 3*e* may be used within the spirit of the present invention. As best shown in FIG. 4, a portion of the pad may be compressed by and into the top portion 3*e* of the upper housing 3 as indicated by the arrow labeled C. The pad 2 may be made of an elastomeric material, or a foam-like material or other type or kind of compressible material either now known or later developed in the future. Embodiments are also envisioned in which the compressible member may take the form of a spring-like element. Depending on the design choice of the compressible member for a particular embodiment according to the present invention, a person skilled in the art would be able to determine suitable dimensions without undue experimentation so as to contact the top portion 3*e* of the upper housing 3 when the cover 1 is closed in order to push or urge the disposable pump head into the cavity 12*d* and frictionally engage the motor 20.

The bottom wall portion 12*b* is also configured with an opening (unlabeled) so that the cam 10 can be coupled to the shaft 20*a* of the motor 20. The cover 1 is configured to detachably couple to the exterior wall portion 12*a* for opening the canister 12 to change the disposable pump head assembly 100*a* and for closing the canister 12 after the disposable pump head assembly 100*a* has been changed. The canister 12 is also configured with openings 12*f*, 12*g* that are shaped so as to receive the ports 3*b*, 3*c* respectively of the pump head assembly 100*a*.

In FIGS. 1*a* and 1*b*, the motor adapter 16 is configured to couple to the motor 20 using four corresponding fasteners, one of which is labeled 16*a*. The motor adapter 16 is also configured to receive the bearing 15 and to rest against and couple to the bottom wall portion 12*b* of the canister 12 using four corresponding fasteners, one of which is labeled 16*b*, so that the bearing 15 is arranged in relation to the cam 10. The motor 20 has a shaft 20*a* configured to pass through the bearing 15 and coupled to the cam 10 of the disposable pump head 100*a*. The canister 12 may take the form of a stand-alone unit, or may be assembled to a wall 30 (see FIGS. 1*a* and 1*b*) of a cabinet or other suitable structure, by, e.g., sandwiching the cabinet between the canister 12 and the mounting ring 14 along with the gasket 13. When mounted to the wall 30, as shown, the mounting ring 14 is configured to be arranged in relation to the motor adapter 16 and to couple to the bottom wall portion 12*b* of the canister 12 to the wall 30 or other suitable structure using four corresponding fasteners, one of which is labeled 14*a*. The gasket 13 is optional and may be arranged between the mounting ring 14 and the bottom wall portion 12*b* of the canister 12, as shown.

The pump head assembly 100*a* may be made from materials that are compatible with the particular application, operation or procedure for which the pump head 100*a* will be used. For example, for the bio tech market the pump head 100*a* can be made from materials that may be irradiated. For other types or kinds of applications, operations or procedures, the pump head assembly 100*a* can be made of materials that depend or specifically relate to some characteristic or requirement of the type or kind of application, operation or procedure. The scope of the invention is not intended to be limited to the type or kind of material either now known or later developed in the future.

The pump head 100*a* may be configured with many different types or kinds of ports 3*b*, including by way of example, sanitary tri clamp ports, threaded ports, quick-connect ports, or any other port configuration either now known or later developed in the future.

FIGS. 2-3

The Canister 12

Figure 2:
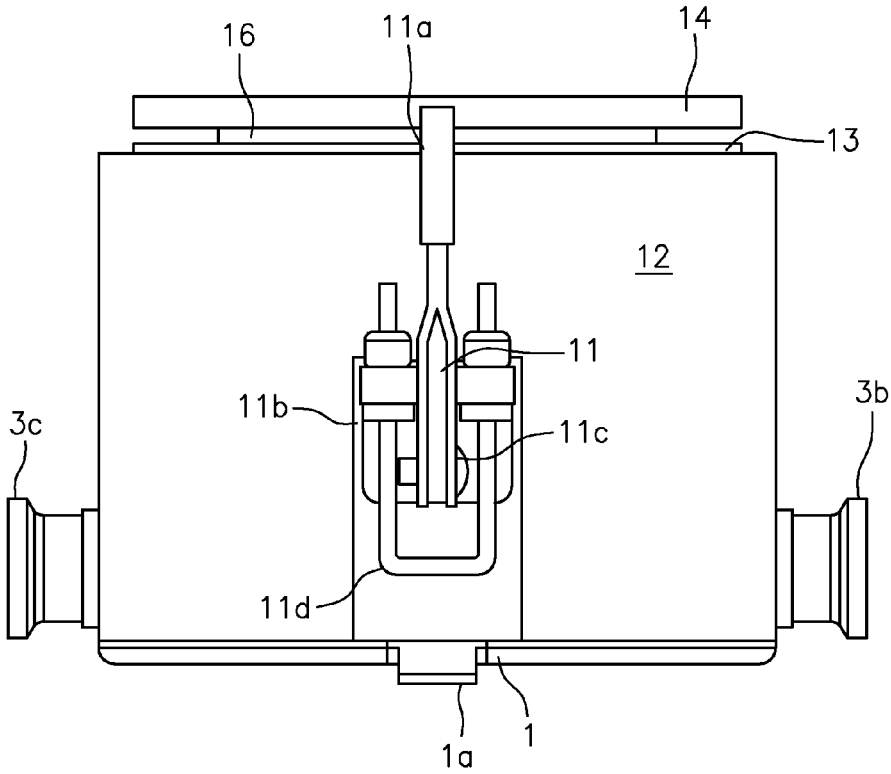
FIG. 2 is a top view of a disposable pump head and canister assembly according to some embodiments of the present invention.
Figure 3:
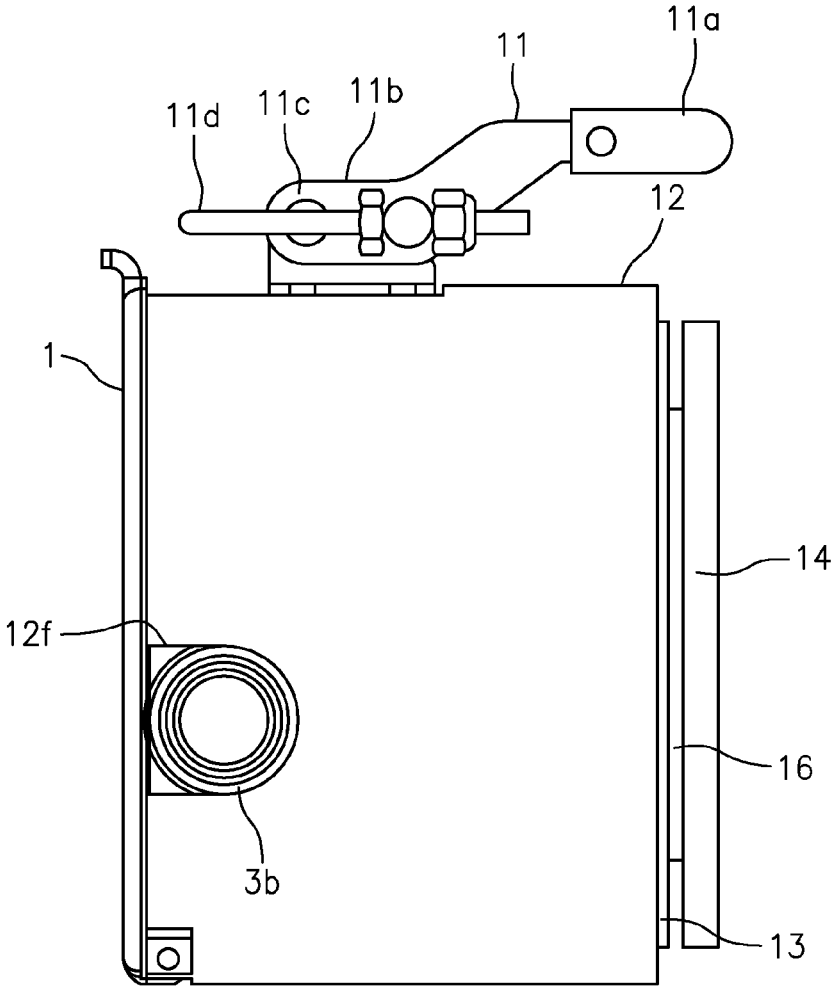
FIG. 3 is a side view of the disposable pump head and canister assembly in FIG. 2 according to some embodiments of the present invention.

FIGS. 2-3 shows other views of the canister 12 having the disposable pump head 100*a* arranged therein and held in place by latching the cover 1 with the clamp 11. The clamp 11 comprises an arrangement of parts, which includes a clamp handle 11*a*, an intermediate part 11*b* that is pivotally hinged on a pivot rod 11*c*, and a latching part 11*d* configured to be detachably coupled to corresponding structure 1*a* of the cover 1. The latching part 11*d* is also hingeably coupled to the intermediate part 11*b* on a pivot rod 11*e*. Embodiments are also envisioned in which the clamp 11 comprises a spring-like arrangement for latching to the cover under tension.

FIG. 4

FIG. 4 shows a cross-sectional view of the disposable pump head 100*a* placed into the canister 12. As shown, the cover 1 is raised into position, closed and clamped in place using the clamp 11. This configuration compresses or pushes the disposable pump head 100*a* and allows for the disposable pump head or unit 100*a* to achieve pressures to operate in the particular application.

FIG. 5

Once the pump head 100*a* is no longer required, e.g., the application, operation or procedure has come to an end, the cover 1 may be opened and the pump head 100*a* may be removed from the canister 12 for disposal.

FIG. 5 shows the steps for changing the disposal pump head 100*a* with a new disposable pump head like a new element 100*a*.

Figure 5A:
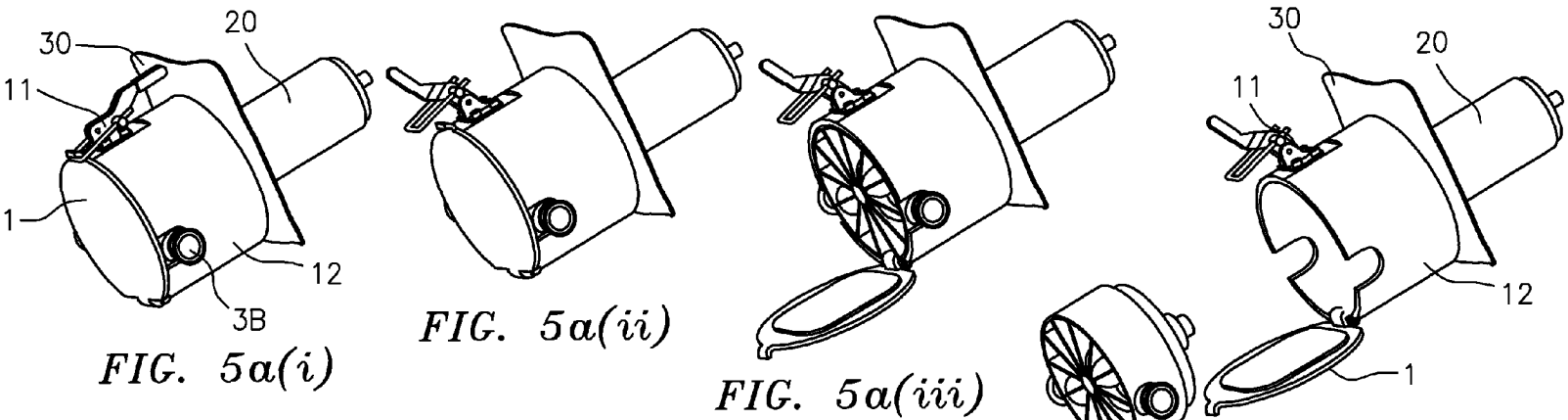
FIG. 5*a*, including 5*a*(i), 5*a*(ii), . . . , 5*a*(vii), is a series of views showing a replacement of a unit with a new unit according to some embodiments of the present invention.
Figure 5A:
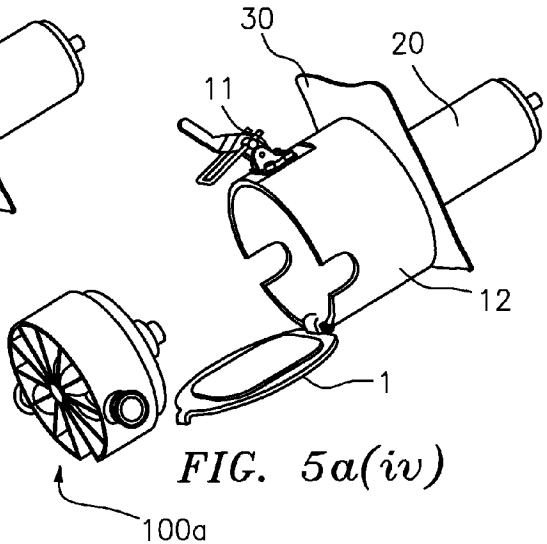
Figure 5A:
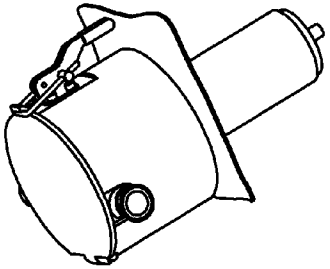
Figure 5A:
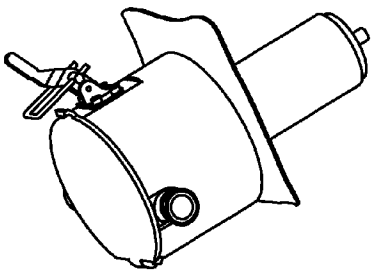
Figure 5A:
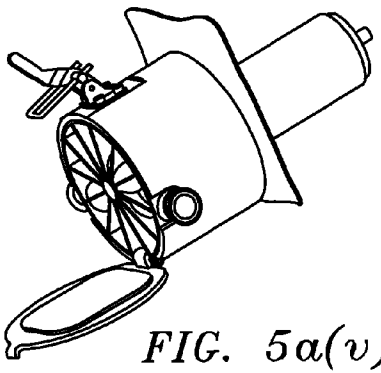

In FIGS. 5*a* (i) and 5*b* (i), the clamp 11 is in place and the canister unit 12 in locked shut. See also the description associated with FIG. 1*a*, which is an exploded view of FIG. 5*b* (i), for further details of that shown in FIG. 5*b* (i), including further details of the elements that comprise the disposable pump head 100*a*.

In FIGS. 5*a* (ii) and 5*b* (ii), the clamp 11 is opened.

In FIGS. 5*a* (iii) and 5*b* (iii), the cover 1 is opened.

In FIGS. 5*a* (iv) and 5*b* (iv), the disposable pump head 100*a* is slid out of the canister 11. See also the description associated with FIG. 1*b*, which is an exploded view of FIG. 5*b* (iv), for further details of that shown in FIG. 5*b* (iv), including further details of the elements that comprise the disposable pump head 100*a*.

In FIGS. 5*a* (v) and 5*b* (v), a new disposable pump head like a new element 100*a* slides into the canister 11.

In FIGS. 5*a* (vi) and 5*b* (vi), the cover 1 is closed.

In FIGS. 5*a* (vii) and 5*b* (vii), the clamp 11 is locked in place and the canister unit 12 locked.

Figure 5B:
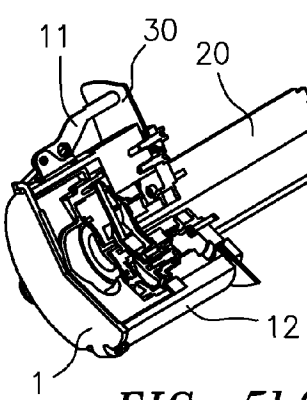
FIG. 5*b*, including 5*b*(i), 5*b*(ii), . . . , 5*b*(vii), is a series of sectional views corresponding to the series of views in FIG. 5*a*, including 5*a*(i), 5*a*(ii), . . . , 5*a*(vii), showing the replacement of the unit with the new unit according to some embodiments of the present invention.
Figure 5B:
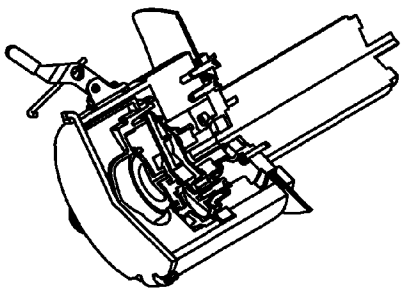
Figure 5B:
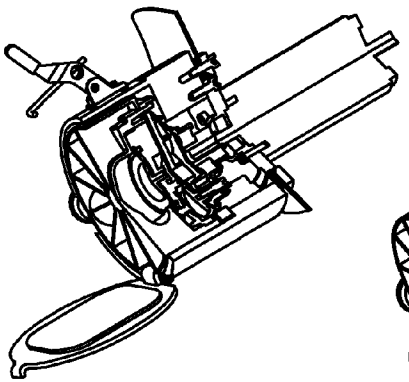
Figure 5B:
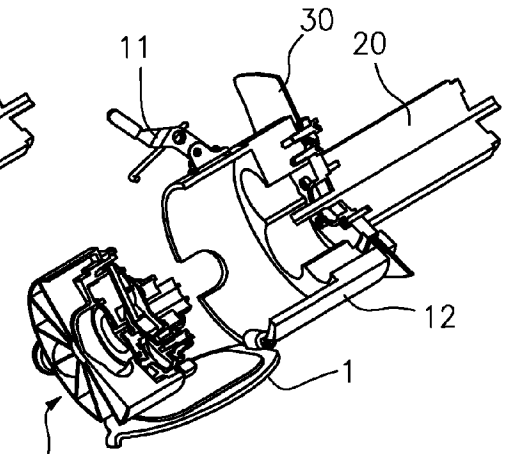
Figure 5B:
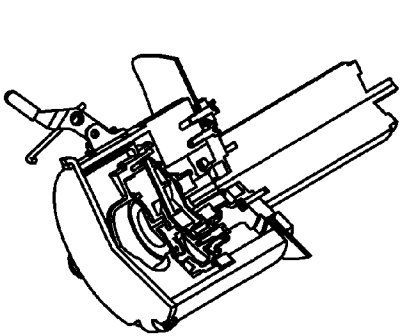
Figure 5B:
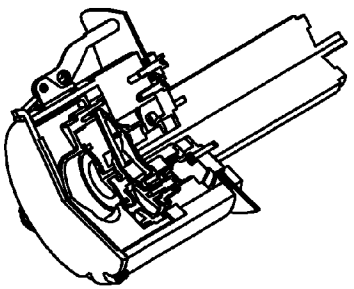
Figure 7A:
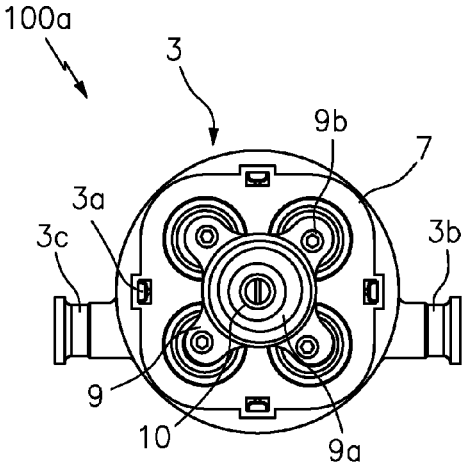
FIGS. 7*a*, 7*b*, 7*c*, 7*d*, shows views of a disposable pump head assembly or pump unit according to some embodiments of the present invention, where
Figure 7B:
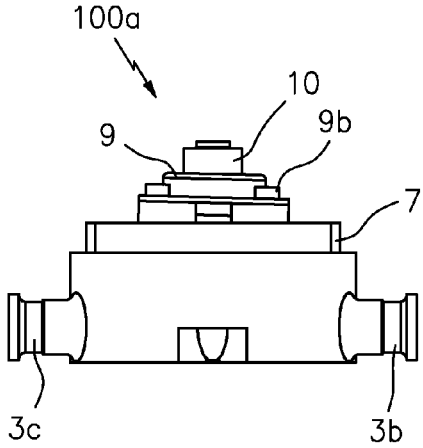
Figure 7C:
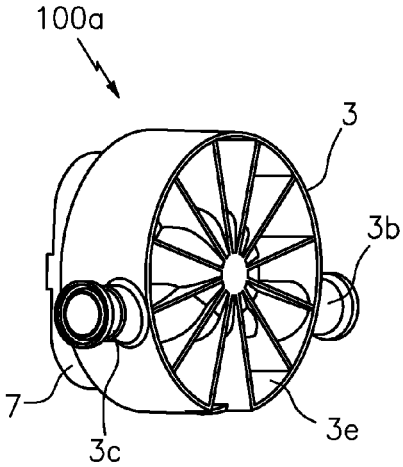
Figure 7D:
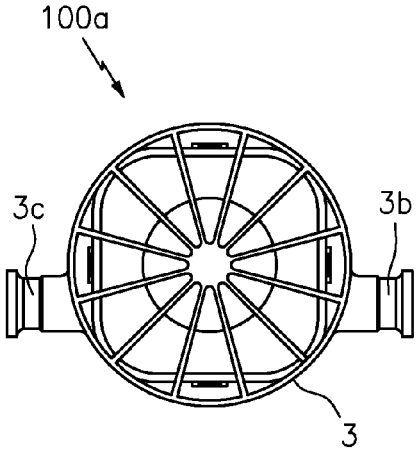

Since the features of FIGS. 5*a*(i) to (vii) and FIGS. 5*b*(i) to (vii) are similar, only relevant features of FIGS. 5*a*(i), 5*b*(i), 5*a*(iv) and 5*b*(iv) with respect to the opening, replacement and closing of the canister 12 are labeled so as not to clutter FIG. 5 as a whole.

The advantage of the present invention is in the ease of assembly/disassembly and the maintenance saved by not having to sanitize the entire system; instead simply removing the pump head assembly 100*a* from the canister 12 and replacing it with a new pump head assembly or unit.

FIG. 6

FIG. 6 shows an enlarged view of the engagement of the cam 100 of disposable pump head 100*a* (see FIGS. 1, 1*a*, 1*b*) to the motor 20. As shown by way of example, this engagement is performed by using a "D" Drive to eliminate the need for fasteners. "D" Drives like that shown are known in the art, and the scope of the invention is not intended to be limited to any particular type or kind thereof either now known or later developed in the future. Moreover, the scope of the invention is not intended to be limited to the use of a "D" Drive engagement, as other types or kinds of motor engagement method can be used that are either now known or later developed in the future.

FIG. 7

FIG. 7 shows other views of the disposable pump head unit 100*a* according to the present invention, which are labeled to the extent needed to be understood relative to the other Figures, including FIGS. 1, 1*a*, 1*b* and consistent with that shown and described herein.

FIG. 8

FIG. 8 shows other views of the canister 12 according to the present invention, which are labeled to the extent needed to be understood relative to the other Figures, including FIGS. 1, 1*a*, 1*b* and consistent with that shown and described herein.

POSSIBLE APPLICATIONS

Possible applications of the present invention may include at least the following: Bio Tech, Food Handling, Beverage, Industrial, and any fluids exchange applications.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. A disposable diaphragm pump head and canister assembly, comprising:

a disposable diaphragm pump head assembly configured as an assembled modular unit having an upper housing with an input port and an output port, the upper housing configured to affixedly couple to a diaphragm support plate, the disposable diaphragm pump head assembly also having a bearing housing configured with walls having a shape and defining openings for receiving reciprocating pistons, the disposable diaphragm pump head assembly also configured with a cam configured to be coupled to a motor for moving the reciprocating pistons in relation to a diaphragm; and a canister configured with an exterior wall portion, a hinged cover portion, a rear wall portion, and a hinged clamping device, the exterior wall portion defining a cavity to receive the disposable diaphragm pump head assembly, the rear wall portion having interior walls formed therein with a corresponding shape to the shape of the walls of the bearing housing to receive and engage the diaphragm support plate and to prevent rotational movement of the disposable diaphragm pump head assembly in relation to the canister when the cam moves the reciprocating pistons in relation to a diaphragm, the rear wall portion also configured with an opening so that the cam can be coupled to the motor, the hinged clamping device configured to couple detachably the hinged cover portion and the exterior wall portion together for opening the canister to change the disposable diaphragm pump head assembly and for closing the canister after the disposable diaphragm pump head assembly has been changed.

2. A disposable diaphragm pump head and canister assembly according to claim 1, wherein the upper housing is configured to couple to the diaphragm support plate via a plurality of upper housing flexible tabs that snap fit to corresponding structure of the diaphragm support plate.

3. A disposable diaphragm pump head and canister assembly according to claim 1, wherein the upper housing is configured to couple to the diaphragm support plate via a snap fit, screws, a sonic weld or rivets.

4. A disposable diaphragm pump head and canister assembly according to claim 1, wherein the hinged cover portion comprises a compressible member, including a compressible pad, dimensioned so as to push a top surface of the disposable diaphragm pump head so as to frictionally engage the disposable diaphragm pump head and the motor.

5. A disposable diaphragm pump head and canister assembly according to claim 1, wherein the hinged clamping device comprises a part for grabbing a lip of the hinged cover portion.

* * * * *